US010480814B1

(12) United States Patent
Rossi

(10) Patent No.: US 10,480,814 B1
(45) Date of Patent: Nov. 19, 2019

(54) APPARATUS AND PROCESS FOR FORMING AN OVAL SHAPED HVAC DUCT

(71) Applicant: Jose E Rossi, Ponce, PR (US)

(72) Inventor: Jose E Rossi, Ponce, PR (US)

( * ) Notice: Subject to any disclaimer, the term of this patent is extended or adjusted under 35 U.S.C. 154(b) by 0 days.

(21) Appl. No.: 15/843,856

(22) Filed: Dec. 15, 2017

Related U.S. Application Data

(60) Provisional application No. 62/472,236, filed on Mar. 16, 2017, provisional application No. 62/487,241, filed on Apr. 19, 2017.

(51) Int. Cl.

| | |
|---|---|
| ***F24F 13/02*** | (2006.01) |
| ***B21B 17/14*** | (2006.01) |
| ***B21D 7/08*** | (2006.01) |
| ***B21B 37/78*** | (2006.01) |
| ***B21B 17/10*** | (2006.01) |

(52) U.S. Cl.
CPC ..... *F24F 13/0245* (2013.01); *B21B 17/10* (2013.01); *B21B 17/14* (2013.01); *B21B 37/78* (2013.01); *F24F 13/0209* (2013.01); *B21D 7/08* (2013.01)

(58) Field of Classification Search
CPC ..... B21B 17/00; B21B 17/10; B21B 17/14; B21B 19/00; B21B 19/12; B21B 19/16; B21B 29/00; B21B 37/38; B21B 37/42; B21B 5/00; B21D 7/02; B21D 7/022; B21D 7/024; B21D 7/08; F24F 13/0245
See application file for complete search history.

(56) References Cited

U.S. PATENT DOCUMENTS

2002/0094233 A1* 7/2002 Price ..... F24F 13/0245 403/338
2002/0100304 A1* 8/2002 Price ..... B21C 37/121 72/50

OTHER PUBLICATIONS 7 in. Diameter Round Duct 90 Degree Saddle Take Off with Gasket, Home Depot; Feb. 4, 2015 (Year: 2015).*
7 in. Diameter Round Duct 90 Degree Saddle Take Off with Gasket, Home Depot (Year: 2019).*

* cited by examiner

*Primary Examiner* — Pradeep C Battula
(74) *Attorney, Agent, or Firm* — Eugenio J. Torres-Oyola; Victor M. Rodriguez-Reyes; Ferraiuoli LLC

(57) ABSTRACT

An apparatus and a process for forming an oval shaped duct, as well as a round duct for all required sizes and thicknesses for an AC system, in one continuous operation where two driving rolls advance a flat metal sheet to a multi-positioning bending roll, where the bending roll is moveable to a bending position for different curvatures and a non-bending position. The driving rolls advance the sheet through while the bending roll bends the sheet to form the curved sides, and the bending roll in the non-bending position form the flat sides of the oval shaped duct. A position sensor detects the position of the flat metal sheet in the rolls to control the location along the sheet where the bending roll is moved to either of the bending or non-bending positions while the driving rolls are stopped.

11 Claims, 7 Drawing Sheets

APPARATUS AND PROCESS FOR FORMING AN OVAL SHAPED HVAC DUCT

CROSS-REFERENCE TO RELATED APPLICATIONS

This application claims the benefit to US of Provisional Applications 62/472,236 filed Mar. 16, 2017 and entitled APPARATUS AND PROCESS FOR FORMING AN OVAL SHAPED AND A ROUND HVAC duct and 62/487,241 filed Apr. 19, 2017 and entitled APPARATUS AND PROCESS FOR FORMING AN OVAL SHAPED HVAC DUCT AND A ROUND DUCT.

GOVERNMENT LICENSE RIGHTS

None.

BACKGROUND OF THE INVENTION

Field of the Invention

The present invention relates generally to a HVAC duct, and more specifically to an apparatus and a process of forming both round and oval HVAC ducts automatically in one continuous cycle, that can replace rectangular ducts that are still predominant in the fabrication of ducts for the air distribution systems in the HVAC industry throughout the world.

Description of the Related Art Including Information Disclosed Under 37 CFR 1.97 and 1.98

In the HVAC (Heating, Ventilation, and Air Conditioning) industry, air is moved through a building using ducts. Typically, these ducts are formed as rectangular cross-sectional shaped ducts since rectangular ducts can be made in the width and heigth best suited to the space made available by the design architect and engineer, and be easily fabricated in small shops with a minimum investment in machinery and equipment. Ducts are positioned between a ceiling and the floor above which is referred to as the duct work space. The duct work space must be tall enough to fit the required duct size so that adequate air flow can be delivered to the various rooms in the building.

Rectangular ducts can be made with the width greater than the height so that increasing the width allows a shorter vertical dimension for the duct and a smaller work space is required for the duct works. However, a rectangular duct is relatively inefficient at moving air as compared to a round duct. A round shaped duct is more efficient and less costly to fabricate and to install than a rectangular shaped duct, and also much less prone to develop air leaks than a rectangular duct, and so are the oval ducts that will be fabricated in the proposed machine. A round duct requires the largest height of the duct works space since its diameter has the same dimension in both the vertical and the horizontal direction. For a building with many floors, the round duct work would require a lot of additional height for the overall building height and even for a one story building the Architect may consider the additional height required for a round duct to be unacceptable since other solutions are available, namely the rectangular ducts, or equivalent oval ducts for the building.

All ducts and other components of an air distribution system for HVAC must be designed, fabricated and installed within the space made available by the architects and engineers engaged in the design of the building for each individual project. This space is normally limited so as not to increase the height of the building more than good design parameters established in the architectural profession.

All utilities installed within buildings, with the sole exception of air distribution duct systems, use round pipes for such distribution. Square or rectangular configurations of water distribution systems in cities disappeared shortly after the fall of the Roman Empire. Rectangular configuration in conveying systems for any fluid have remained a standard only in the HVAC industry.

Round duct fabrication and installation is by far the most economical configuration now available in the HVAC industry. It is also considerably more leak-proof than rectangular ducts. Oval duct fabrication is now specified by design engineers and architects as a substitute for round ducts that cannot fit in the spaces allocated for duct work. Presently, oval ducts are made by first producing a round duct on a first machine, and then using a second machine the round duct is stretched to form an oval shaped duct. The second machine to form the oval shaped duct uses two dies each having the desired curvature of the oval shaped duct so that a number of these dies are needed for different sized oval shaped ducts to be fabricated. However oval duct fabrication costs now soar above those for rectangular ducts except when done in very large quantities. Also, the cost of the equipment now required to fabricate first a round duct and then transform the round duct into an oval duct that will fit within the available space provided by the design architects and engineers is extremely high.

One if not the most important reason for this apparent anomaly is the need to distribute conditioned air throughout a building at very low pressures and discharge it into the conditioned spaces at low velocities and in a noiseless fashion. The design pressure for air distribution purposes ranges from ½ inch to 10 inch water gage. Water and other fluids are commonly moved at 60 to 150 psi in round pipes, at 165 to four hundred and ten times the pressure for 10 inches water gage. Therefore, conveyance of air inside buildings at high pressures in small sized piping is not acceptable due to noise considerations as well as to comfort considerations for personnel occupying the air conditioned areas. Small ducts to carry air at high speed and high pressure would create high noise and discharge the air from the outlet at high speed into a room that would create discomfort for the people occupying the room. Thus any improvement contemplated for this industry in its air distribution systems must take into consideration the need for low velocity and noiseless discharge of conditioned air into occupied spaces.

Replacing a rectangular shaped duct with a round duct is not feasible in all cases, particularly for large amounts of air because of the limited space allowed by Architects and design engineers for ductwork inside buildings. For the round shaped duct to replace the rectangular shaped duct, the round duct would have a diameter greater than the height of the rectangular shaped duct to move the same amount of air. An oval shaped duct would be required to replace a rectangular shaped duct in the same space and with the same air flow.

An oval shaped duct with a width greater than the height has been proposed which is more efficient at moving air than a rectangular duct but takes up the same amount of space than the rectangular duct. However, the current process of forming an oval duct is very costly at present, such that the less efficient rectangular ducts are still being used predominantly, in the great majority of cases as compared to the combination of round and oval ducts. Presently to form an oval duct, a round duct is first formed. Then, the rounded duct is placed on a second machine, outside two beams which are pushed apart by hydraulic force stretching the duct to form the oval shape. Thus, the cost of producing oval shaped duct is not cost-effective for most of the HVAC projects. Also the probability for air leaks is increased due to the stretching force of the two beams in the spiral joint around duct being stretched out with considerable force.

A factor for air leakage permitted in a rectangular duct configuration is twice as great as that allowed for round and oval-shaped ducts. But round and oval-shaped ducts also have a very significant permissible air-leakage factor for all installations of the Air Distribution Systems in the HVAC Industry. Energy saving and Green Buildings are part of our everyday advancements in modern methods for building construction. The HVAC industry has fallen behind in this trend due to the technology used during the past thirty years or more that still make the inherently inefficient rectangular construction of ducts for the air distribution systems in HVAC industry totally prevalent over the more efficient round and oval shaped configuration of ducts. And even the round and oval shaped ducts manufactured up to this day suffer from a technology that has not changed or been improved for several decades.

BRIEF SUMMARY OF THE INVENTION

An apparatus and a process of forming round and oval shaped HVAC ducts using a single piece machine in which a flat sheet of metal is rolled using three rollers, one of which can be variably positioned during the rolling process to form the different curvatures in order to form an oval shaped duct or a round duct. The rolls of the machine shall be no less than 5 feet in length, or higher depending on the availability of the raw material for sheets or coils over 5 feet wide. The machine can form either oval ducts or round ducts from flat or bead reinforced sheets of galvanized steel from 26 gage to 16 gage, in a single continuous pass for all sizes and thicknesses, as required in the HEATING, VENTILATNG AND AIR CONDITIONNG INDUSTRY (HVAC) Industry. With the present invention, there is no restriction on duct size since no dies are necessary in the formation of the oval shaped duct.

During fabrication of the oval shaped duct, sealing beads are also formed in the one end of the flat sheet in the single continuous pass to form the duct so that a zero leakage installation can be accomplished.

To form the oval-shaped ducts two driving rolls (called Pinch Rolls) pull the flat or bead reinforced sheet of metal through while one bending roll is moved into different positions to form the curved sections of the oval shaped duct. A sensor is used to detect how far the sheet metal has moved through the rolls so that the two flat sides and the two curved sides of the oval shaped duct are formed with enough precision and accuracy that adjacent sections of ducts can be assembled together without leakages of air. A first section of the first flat side of the duct is formed first, and then the first curved section is formed, followed by the second flat section, and then the second curved section formed by moving the bending roll into or out of position for the curved section or for the flat secton. After the second curved section is formed, the two flat sections that form the first flat section of the duct are welded, or otherwise joined and sealed together longitudinally to form an enclosed oval shaped duct. The oval shaped duct is thus formed in a continuous operation, except for the longitudinal joint that is secured after the fabrication process is finished.

A control panel with a touch screen is used to control the bending rolls to move to two positions for each different size of an oval duct during the rolling operation. A pneumatic system, or a rack and pinion system or other mechanical mechanisms is used to control the position of the bending roll.

The bending roll can be moved into and out of position to form an oval shaped duct, or it can be moved into position to form a circular or round-shaped duct. The two driving rolls and the bending roll can be equipped with male beads and female grooves to form reinforcing beads on the duct. And, each end of the two driving rolls can include a crimping ring to form a crimp on one end of the duct for insertion into another duct. Two beads of sealer material are placed in the crimped section of the round or oval duct material automatically as the duct is being formed.

To form the round ducts the bending roll is moved to the position to form the round duct for the diameter required and held in that position until the total 360° round form is completed and then ejected from the machine.

DETAILED DESCRIPTION OF THE INVENTION

The present invention is for a machine that can fabricate all sizes and thicknesses of round and oval ducts that may be required for any Air Distribution System designed for the HVAC system within a building or other enclosures or similar applcatons. This is a machine that will automatically fabricate a complete set of round ducts or a complete set of oval shaped HVAC ducts in one continuous process and on one machine for a minimal cost, with reinforced flat material, and with a crimped end and two sealing beads placed on the crimped end all in one pass through the machine.

Figure 10:
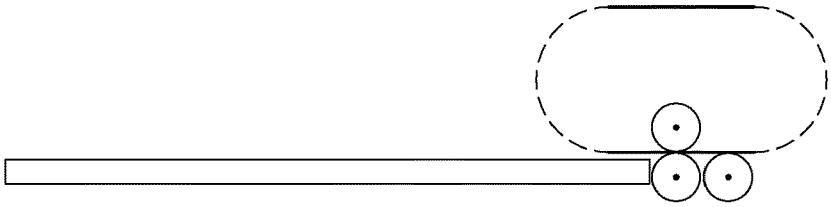
FIG. 10 shows a cross section side view of an oval-shaped duct formed by the apparatus and process of the present invention.

An oval shaped duct has two straight sides with two sides that are rounded that form a racetrack shaped duct automatically like that shown in FIG. 10. The apparatus and process of forming an oval shaped duct, as well as a round duct must be capable of forming each duct with a high precision so that sections of ducts can be assembled to form a continuous duct line or assembly with no leakage of air. The apparatus and process of forming the oval shaped duct of the present invention can take a flat sheet or a bead-reinforced sheet of metal and form the two straight sides and the two rounded sides in one continuous operation using two rolls that advance the sheet metal through and a third roller that bends the rounded semi-circular ends. The Round Ducts are formed in the same machine also in one continuous operation at a much faster pace than the oval duct since the bending roll keeps the same position throughout the total bending process for these ducts.

Figure 1:
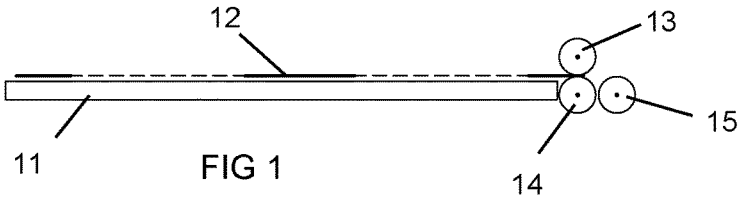
FIG. 1 shows a cross section side view of the oval-shaped duct forming apparatus of the present invention with flat metal sheet in position to be pulled through the rolls.

FIG. 1 shows the basic apparatus that will provide the oval shaped duct and includes a bed 11 on which a flat sheet of metal 12, or a bead reinforced sheet of metal of the thicknes required is placed that will be formed into the oval shaped or the round duct. Two drive rolls are located on one end of the bed 11 that are connected to a motor to pull the flat or bead reinforced sheet of metal 12 through and include an upper drive roll 13 and a lower drive roll 14. Both drive rolls 13 and 14 can be adjusted to pull the various gages of sheet metal required in the HVAC industry for air distribution designed for buildings or other enclosures. A third roll is an adjustable positioning bending roll 15 that will form the curved ends of the oval shaped duct or the total circular form for the round duct. For the oval ducts the bending roll 15 is moveable in a vertical direction to one of two positions that include a non-bending position and a bending position. The bending position with be at a position to provide a specific curvature in the two rounded ends for the oval shaped duct, or for a specific curvature for the round duct. The positioning of the bending roll 15 must be accurate enough that the curved sections of the duct are reproduced for each of the oval shaped ducts, and for the round duct formed by the apparatus, so that sections can be connected together to form a complete duct line assembly without any leakage of air. A sensor is required to determine how far the flat sheet 12 has moved through the rolls so that each of the flat sides are formed consistently and the curved sides are formed just as consistently for each oval shaped duct so that sections of ducts can be assembled without leakages of air. The same requirement for consistent fabrication exists for the round ducts as for the oval ducts.

A sensor will be used on one of the driving rolls 13 and 14 that can determine the amount of sheet metal passed through for purposes of controlling the length of the flat sides and the start and ending of the formation of the curved sides. The sensor can detect the movement of the sheet through the rollers or the rotation of one or both rollers in order to determine the position of the sheet through the machine. Other sensors can be used to detect the length of movement of the metal sheet through the rolls in order to form the flat and curved sections with the required precision to form oval shaped ducts. A track and pinion mechanism or similar mechanisms may be used for this purpose.

Figure 2:
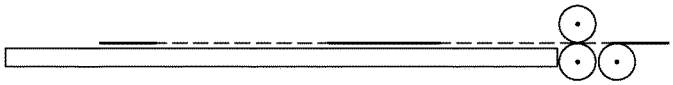
FIG. 2 shows a cross section side view of the oval-shaped duct forming apparatus of the present invention with a first flat piece being formed.
Figure 3:
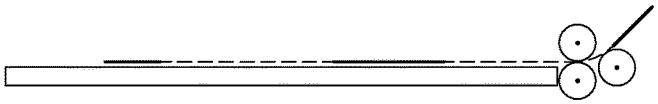
FIG. 3 shows a cross section side view of the oval-shaped duct forming apparatus of the present invention with a curved section of the sheet being formed.
Figure 4:
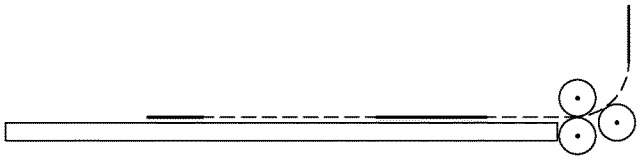
FIG. 4 shows a cross section side view of the oval-shaped duct forming apparatus of the present invention with a first half of the first curved end of the duct being formed.
Figure 5:
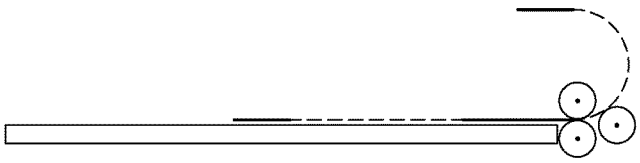
FIG. 5 shows a cross section side view of the oval-shaped duct forming apparatus of the present invention with the first curved end of the duct being formed.

FIG. 2 shows the two driving rolls 13 and 14 pulling the flat sheet through. After a specific length of the flat sheet has been pulled through, the driving rolls 13 and 14 are stopped and the bending roll 15 is moved up into place to begin forming the curvature in the duct. FIG. 3 shows the beginning of the curvature being formed. FIG. 4 shows the first half of the first curved side of the duct formed. FIG. 5 shows the first curved side of the duct totally formed.

Figure 6:
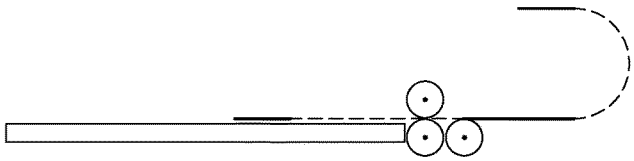
FIG. 6 shows a cross section side view of the oval-shaped duct forming apparatus of the present invention with the second flat side of the duct being formed.
Figure 7:
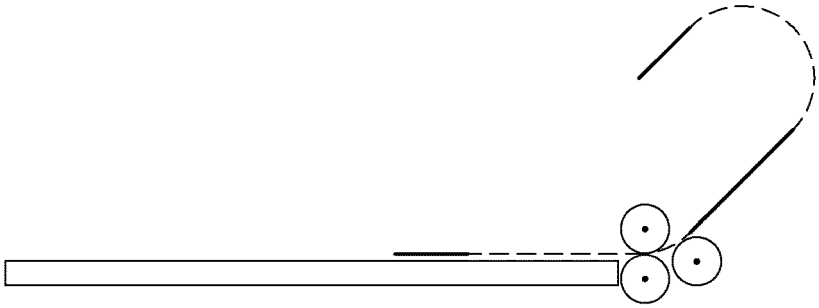
FIG. 7 shows a cross section side view of the oval-shaped duct forming apparatus of the present invention with a start of the second curved end of the duct being formed.
Figure 8:
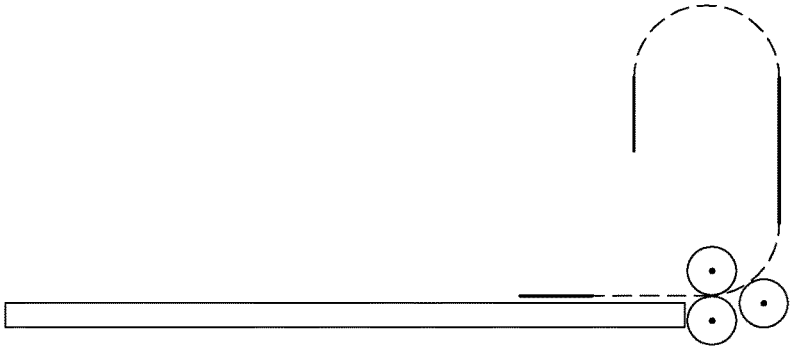
FIG. 8 shows a cross section side view of the oval-shaped duct forming apparatus of the present invention with a first half of the second curved end of the duct being formed.
Figure 9:
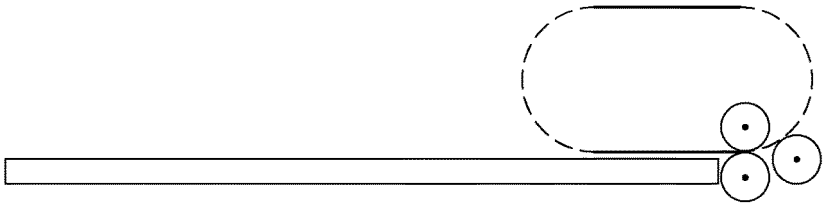
FIG. 9 shows a cross section side view of the oval-shaped duct forming apparatus of the present invention with the second curved end of the duct being formed.

After the first curved side of the duct is formed (FIG. 5), the two driving rolls 13 and 14 are stopped and the bending roll 15 is moved to the flat forming position. Then, the two driving rolls 13 and 14 pull the sheet through to form the second flat side of the duct (FIG. 6). After the first flat side of the duct is formed, the two driving rolls 13 and 14 are stopped and bending roll 15 is moved into the bending position. Then, the two driving rolls pull the sheet through to form the beginning of the second curved side of the duct as seen in FIG. 7. The two driving rolls 13 and 14 continue to pull the sheet through with the bending roll 15 in the bending position to form the first half of the second curved side of the duct (FIG. 8) and then form the second half of the second curved side of the duct (FIG. 9). At this point, the two driving rolls 13 and 14 are stopped and the bending roll 15 is moved to the non-bending position. Then, the two driving rolls 13 and 14 pull the flat side of the duct through (FIG. 10) to where the two side ends of the duct are located.

FIG. 1-10 show the various positions of the sheet metal being formed into an oval shaped duct with two curved sides and two flat sides that are symmetric. The two driving rolls 13 and 14 pull the sheet through the apparatus and the bending roll 15 is moved into and out of the bending position to form the curved sides of the duct. Each flat side and each curved side of the duct must have lengths and curvatures formed with such precision that the shape of all ducts can be duplicated so that several of the oval shaped ducts can be joined together to form a duct line assembly for an HVAC system. The oval shaped duct in FIGS. 1-10 is formed in one continuous automatic operation. The proposed machine has the capacity required to form round and oval ducts automatically for all sizes and thicknesses required for any air distribution system in the HVAC industry since the machine is designed and built for such purpose.

Figure 11:
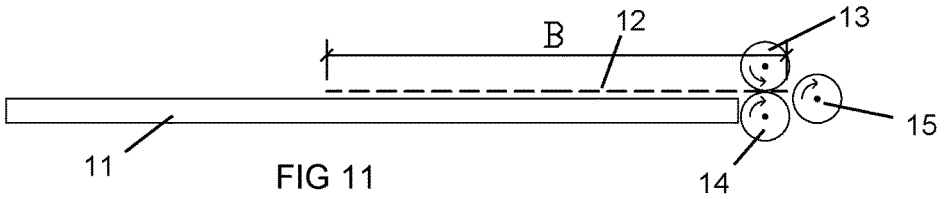
FIG. 11 shows a cross section view of a flat sheet in position to be formed into a circular shaped duct of the present invention.
Figure 12:
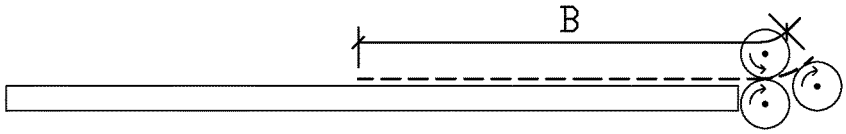
FIG. 12 shows a cross section view of the circular shaped duct beginning to be formed of the present invention.
Figure 13:
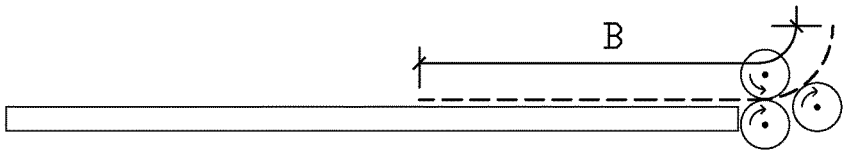
FIG. 13 shows a cross section view of the first quarter section of the circular duct being formed of the present invention.
Figure 14:
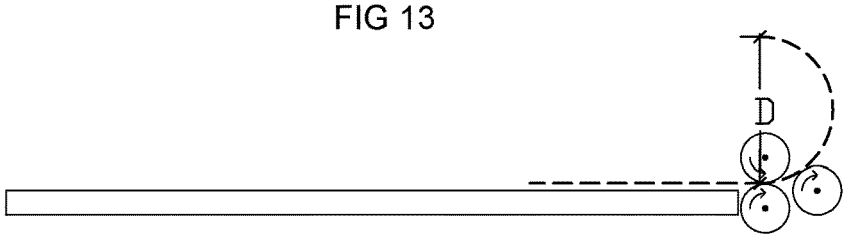
FIG. 14 shows a cross section view of the first half section of the circular duct being formed of the present invention.
Figure 15:
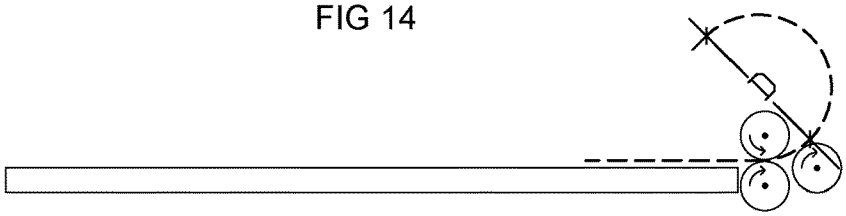
FIG. 15 shows a cross section view of the ⅝ths section of the circular duct being formed of the present invention.
Figure 16:
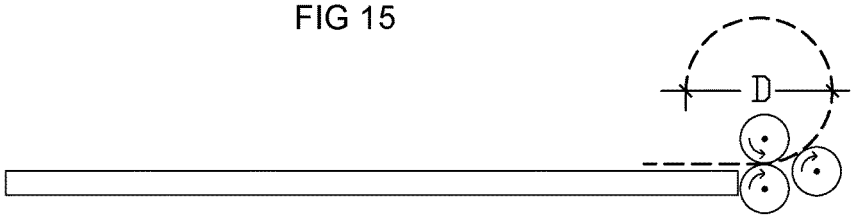
FIG. 16 shows a cross section view of the first three quarters section of the circular duct being formed of the present invention.
Figure 17:
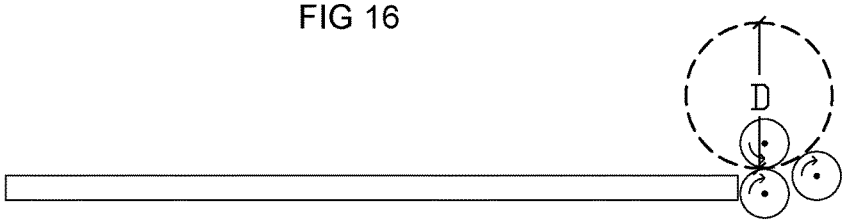
FIG. 17 shows a cross section view of the full circular duct formed of the present invention.

The oval shaped duct forming apparatus and process of the present invention can also form a circular shaped duct. FIGS. 11 through 17 shows the various stages of the formation of such circular shaped duct. The structure of the duct forming apparatus to form the circular shaped duct is the same as that in the oval shaped duct forming apparatus, except that the bending roller stays in the bending position the entire time without stopping the driving rolls. FIG. 11 shows the flat sheet metal being pulled through by the two driving rolls 13 and 14. FIG. 12 shows the bending roll 15 in the bending position with the two driving rolls 13 and 14 pulling the sheet through to start forming the circular shaped duct. FIG. 13 shows the first quarter section of the circular shaped duct formed. FIG. 14 shows the first half section of the circular shaped duct formed. FIG. 15 shows the first ⅝ths of the circular shaped duct formed. FIG. 16 shows the first ¾s of the circular shaped duct formed. FIG. 17 shows the entire circular shaped duct formed. In the circular shaped duct forming apparatus and process, the bending roll 15 is in the bending position at all times as the two driving rolls 13 and 14 are pulling the sheet through.

Figure 18:
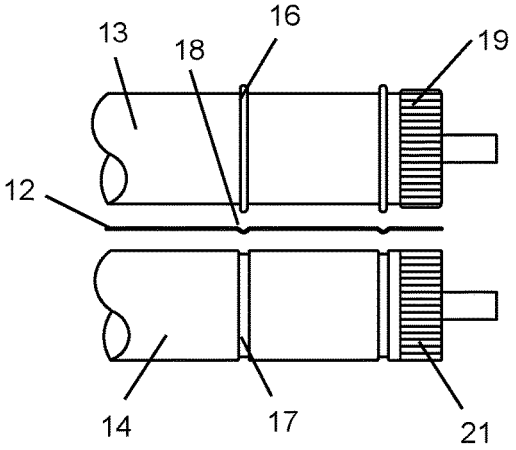
FIG. 18 shows a section of the two rolls that form beadings and a crimp end of each of the ducts formed by the rolls of the present invention.

FIG. 18 shows the two driving rolls with structure to form beads on the duct and crimps on one end of the duct. The driving roll 13 has a number of annular raised rings 16 while the driving roll 14 has an equal number of annular depressions or slots 17 opposite to the rings 16. The driving roll 13 is a male beading roller while the driving roll 14 is a female beading roller. The beading rings 16 and depressions 17 are positioned in one embodiment along the rolls every 5 1/16 inches or other adequate distance for each particular machine and product. Each set of rolls 13, 14 and 15 are at least 5 feet in length in order to form a standard length duct of five feet. As the two driving rolls 13 and 14 pull the sheet through to form the oval or circular shaped duct, the beading rings 16 and depressions 17 will form beading in the sheet that add stiffness to the sheet and therefor to the finished duct piece, so that lighter gage material can be used in accordance with SMACNA and ASHRAE requirements.

Figure 19:
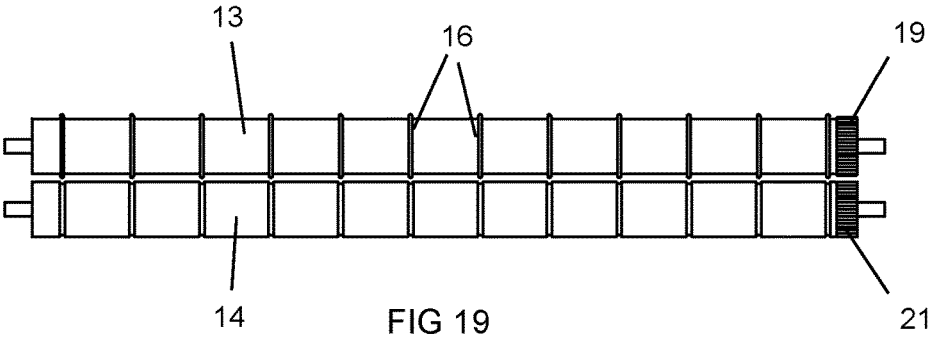
FIG. 19 shows the two rolls with the bead forming raised rings and depressed slots and the crimping beads of the present invention.

FIG. 19 also shows the two driving rolls 13 and 14 to have crimping rings 19 and 21 on one end of the both rolls that together from a crimp on one end of the duct. The bending roll will also have the same female grooves as roll 14 so that the beads on the reinforced metal sheet will not be deformed while being formed into its round curvature. FIG. 19 shows two rolls 13 and 14 in the full length with the crimp rings 19 and 21 on one end.

Figure 20:
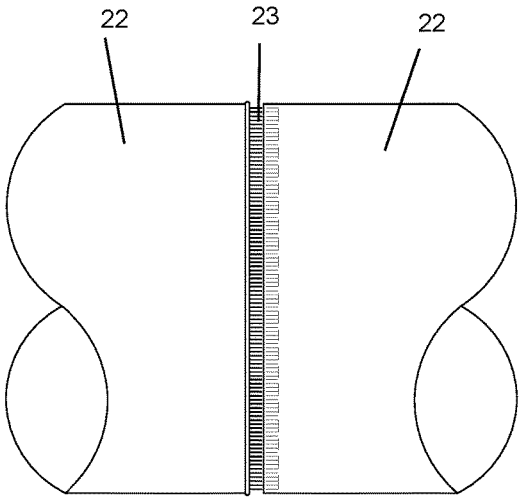
FIG. 20 shows an enlarged section of two ducts formed with a crimped end that fits within a non-crimped end of an adjacent duct of the present invention.
Figure 21:
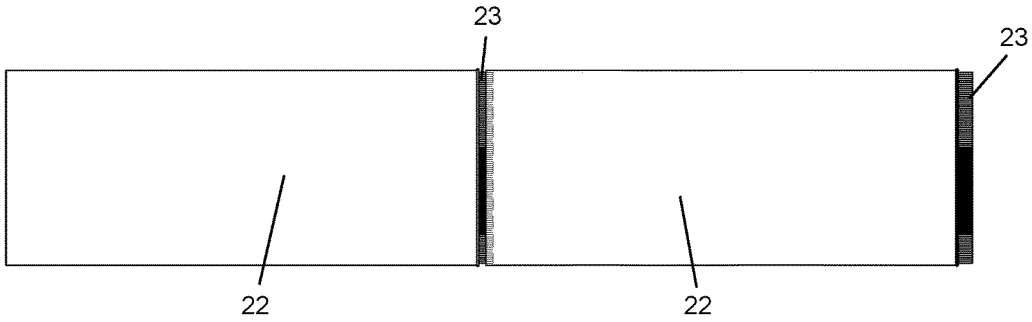
FIG. 21 shows two full ducts secured together with the crimped end inside a non-crimped end of the present invention.
Figure 22:
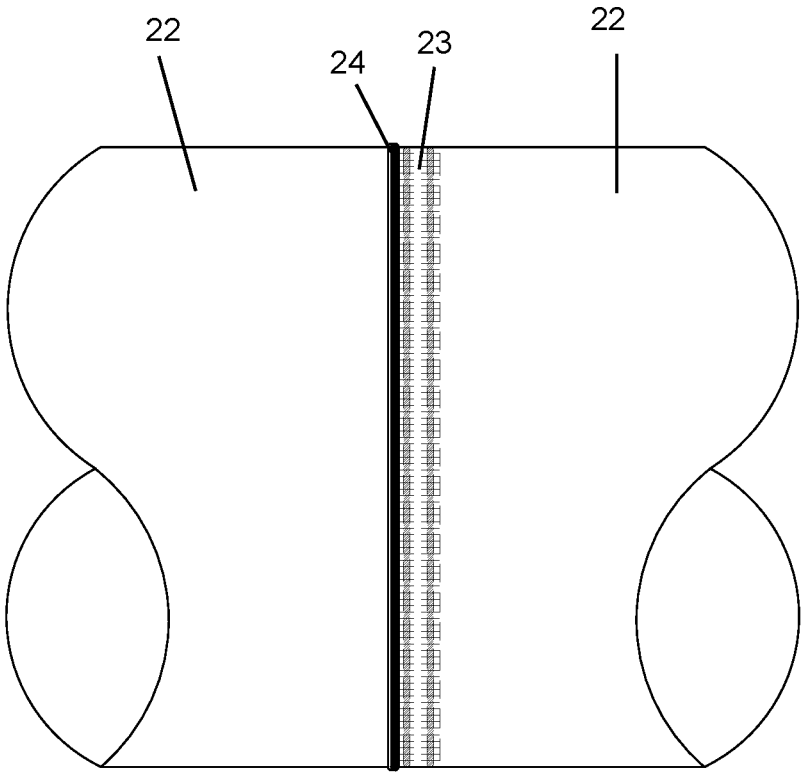
FIG. 22 shows two ducts secured together with a crimped end within a non-crimped end and a seal bead applied to one end of one of the ducts of the present invention.
Figure 23:
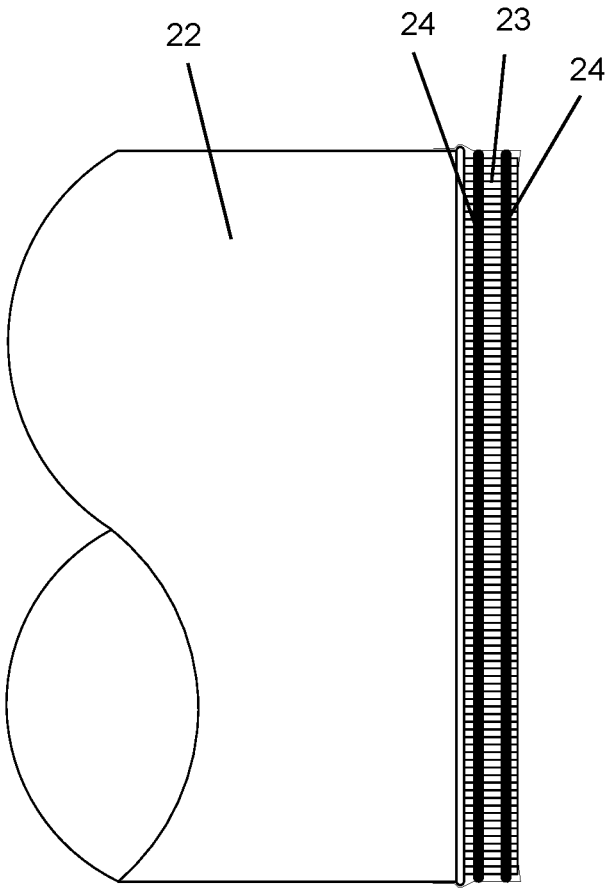
FIG. 23 shows a duct with a crimped end having two seal beads applied to the crimped end for sealing to an adjacent duct of the present invention.

The crimped end of the duct will form a smaller diameter end such that the crimped end of one duct can be inserted into another duct downstream of the former one and into on its non-crimped end. FIG. 21 shows two ducts 22 secured together with one open end having the crimped form 23 that is inserted into the non-crimped end of a second duct 22. FIG. 20 shows an enlarged view of sections of two ducts 22 with the crimped end 23 inserted into the non-crimped end of the second duct 22. The beading and the crimping can be done on both the oval shaped ducts as well as on the circular shaped ducts during the single continuous pass that forms the round or oval shaped duct. A sealing bead 24 is automatically placed in two rings around the crimped end to assure proper sealing in the transverse joints between adjacent duct pieces. Installers are advised to place an additional sealing ring 24 between the crimped end and the bead next to it upon the installation of each duct piece for further assurance against air leaks in the duct line assembly. FIG. 22 shows two ends of two ducts 22 with a sealing ring 24 applied on the crimped end 23 of one of the ducts. FIG. 23 shows a duct in which the crimped end 23 has two sealing rings 24 applied to provide a greater seal that would one ring.

Thus, the apparatus and process of forming oval shaped ducts, and round ducts of the present invention can take any gauge of flat sheet metal, or bead reinforced sheet metal that is used to form HVAC ducts, and form an oval shaped duct having two straight sides and two curved sides by advancing the flat sheet through rolls to form first a flat side, then a first curved side, then advancing the sheet metal through to form the second flat side, and then further advancing the sheet metal through to form the second curved side, and then joining the end of the first flat side together with that of the last flat side to form the oval shaped duct. By controlling the precise location of bending of the two curved sides, an oval shaped duct can be formed with high precision so that sections can be secured together without any leakages of air.

The apparatus and process of the present invention can also be used to form a circular shaped duct without modifying the structure of the oval shaped duct forming apparatus. Only the controls need to maintain the bending roll in the bending position to form the full circular shaped duct. Adding the circular shaped duct forming capability to the oval shaped duct forming apparatus and process will allow for both oval and circular shaped ducts to be formed using the same machine for all sizes and thickness of material required for air distribution systems in the HVAC Industry. Also, a crimped end can be formed during the single continuous pass duct forming process with a sealing ring applied to the crimped end. The benefit of an apparatus that can form both oval and circular shaped ducts for all sizes and thicknesses required in this industry is that circular shaped ducts can be formed wherever a building has enough space to fit a circular shaped duct, and the apparatus can form the oval shaped ducts where the building space cannot fit the circular shaped duct. With the round and oval shaped duct forming apparatus of the present invention, customized shaped and sizes ducts can be formed at the job site with a minimal cost and effort over the prior art apparatus, and also provide the ducts with zero leakage capability in that crimped ends and ring seals can be applied during the duct forming process on site as well.

The apparatus and process of the present invention disclose that the oval shaped duct is formed with the two ends that are to be joined to form the oval shaped duct are at a middle of one of the flat sides. However, the two ends that are to be joined together can be located anywhere along the sides of the ducts without departing from the spirit or scope of the present invention. The two ends that are to be joined can be joined within the apparatus that formed the oval shaped or circular shaped duct, or can be joined later by hand or by a second machine for a more economical machine initially.

To form the oval shaped duct, the driving rolls are stopped at a desired position of the flat metal sheet so that the bending roll can be moved into or out of position. This stopping and starting of the two driving rolls is required to precisely form the curved sections and the flat sections with proper lengths (flat or arc lengths) so that the duct shape can be repeated and that several ducts can be assembled together to form the HVAC ducting. However, these stops are of so short a duration that the driving rolls can be almost continuously operated without stopping while the bending roll is moved into and out of the bending position. The advancement of the flat metal sheet through the three rolls can form the sides of the duct with an accuracy such that several ducts can be easily and quickly assembled to form the ducting assemblies.

I claim the following:

1. A process of forming an oval shaped HVAC duct in a single pass through a roller machine, the oval shaped HVAC duct having two flat sides and two rounded sides, the process comprising the steps of:

forming a first section of a first flat side of the oval shaped duct;

forming a first rounded side of the oval shaped duct;

forming a second flat side of the oval shaped duct;

forming a second rounded side of the oval shaped duct;

forming a second section of the first flat side of the oval shaped duct; and, securing the first and the second sections of the first flat side of the oval shaped duct together in a sealed connection;

wherein the HVAC duct is a straight duct with a constant cross section flow area from an inlet to an outlet, and the HVAC duct is without any radial flange.

2. The process of forming an oval shaped HVAC duct of claim 1, and further comprising the step of:

where the oval shaped duct is a four to six feet in length.

3. A process of forming an oval shaped HVAC duct in a single pass through a roller machine, the oval shaped HVAC duct having two flat sides and two rounded sides, the roller machine having two driving rollers and one bending roller located downstream from the two driving rollers, the process comprising the steps of:

moving a flat metal sheet to be formed into an oval shaped duct through the two driving rollers with the bending roller in a bending position to form one curved side of the oval shaped duct;

moving the bending roller to a non-bending position;

moving the flat metal sheet through the two driving rollers to form one flat side of the oval shaped duct;

moving the bending roller to a bending position; and, moving the flat metal sheet through the two driving rollers to form a second curved side of the oval shaped duct;

wherein the HVAC duct is a straight duct with a constant cross section flow area from an inlet to an outlet, and the HVAC duct is without any radial flange.

4. The process of forming an oval shaped HVAC duct of claim 3, and further comprising the steps of:

forming a first section of a second flat side before forming the two curved sides; and, forming a second section of the second flat side after forming the two curved sides.

5. The process of forming an oval shaped HVAC duct of claim 3, and further comprising the step of:

prior to moving the bending roller into the bending position or the non-bending position, stopping the two driving rollers from moving the flat metal sheet.

6. The process of forming an oval shaped HVAC duct of claim 3, and further comprising the step of:

crimping one end of the oval shaped duct such that a diameter of the crimped end of the duct can fit inside an end of a non-crimped end of a second oval shaped duct.

7. The process of forming an oval shaped HVAC duct of claim 6, and further comprising the step of:

adding a ring of sealing material on the crimped end of the machine to prevent leakage of air from two joined ducts when installed in a space.

8. The process of forming an oval shaped HVAC duct of claim 3, and further comprising the step of:

forming a plurality of annular shaped beading on the oval shaped duct as the flat metal sheet is being moved through the two driving rollers.

9. The process of forming an oval shaped HVAC duct of claim 3, and further comprising the step of:

forming a plurality of annular shaped beading on the oval shaped duct as the flat metal sheet is being moved through the two driving rollers.

10. The process of forming an oval shaped HVAC duct of claim 3, and further comprising the step of:

the oval shaped duct with the two curved sides and the two flat sides is formed in one continuous movement through the machine.

11. The process of forming an oval shaped HVAC duct of claim 3, and further comprising the step of:

where the oval shaped duct is a four to six feet in length.

* * * * *